United States Patent [19]

Nugent

[11] Patent Number: 4,898,011

[45] Date of Patent: Feb. 6, 1990

[54] LOCK

[75] Inventor: Walter J. Nugent, Melbourne, Australia

[73] Assignee: Walter Locks Pty Ltd., South Yarra, Australia

[21] Appl. No.: 166,644

[22] Filed: Mar. 11, 1988

[30] Foreign Application Priority Data

Mar. 13, 1987 [GB] United Kingdom ..... 8705948

[51] Int. Cl.[4] ..... E05B 17/04

[52] U.S. Cl. ..... 70/379 R; 70/352

[58] Field of Search ..... 70/379 R, 380, 350, 70/352, 406, 409, 454, 382; 242/244, DIG. 66

[56] References Cited

U.S. PATENT DOCUMENTS

| | | | |
|---|---|---|---|
| 92,354 | 7/1869 | Pfleghar | 292/244 |
| 1,758,620 | 5/1930 | Rebori | 70/409 |
| 3,736,780 | 6/1973 | Singer | 70/453 |
| 4,539,829 | 9/1985 | Givol | 70/454 |

FOREIGN PATENT DOCUMENTS 2559826 4/1985 France .

*Primary Examiner*—Robert L. Wolfe

*Attorney, Agent, or Firm*—Arnold, White & Durkee

[57] ABSTRACT

A lock has a drive member which is moved to actuate the lock. A plurality of elongate members are connected to the drive member, one end of each elongate member being inserted in a respective spring-biased plunger. A first contoured element locates the plungers in position. An appropriate key must be inserted with a contoured surface in contact with a second set of plungers to align passages in the second set of plungers with the ends of the elongate members to enable the elongate members to move, thus permitting the lock to be opened.

23 Claims, 8 Drawing Sheets

LOCK

BACKGROUND TO THE INVENTION

The present invention relates to a lock and more particularly relates to a lock suitable for use in a domestic, office or hotel environment or the like, although embodiments of the invention may comprise locks for car doors, or vehicle ignition locks, or locks for windows, patio doors or the like.

There are many situations where locks are utilised where a large number of people may have access to keys of the lock. For example, in an office environment, various members of the staff who work in the office may be provided with keys. If a member of staff has to be dismissed for any reason, even if the member of staff hands in his or her keys it is always possible that they have had copies of the keys made, and thus if the security of the office is to be guaranteed it is necessary, at the present time, to change the locks in order to ensure that no unauthorised person can obtain access to the office.

In a domestic situation, when a person buys a house from another person, even though it is usually understood that the person selling passes over all available keys to the person buying, there is always a doubt that this has been done, and thus most prudent people again change all the locks.

In a hotel situation, each guest who occupies a room has access to the key of the room and may make an unauthorised copy. This certainly reduces the level of security available to successive guests in the same room, and attempts have been made to overcome this problem by utilising electronic locks where an electronic device is provided associated with each lock adapted to "recognise" a particular key, and in response to such recognition of a key, the lock is electrically opened. The functions of such units are mainly controlled access and in the majority of situations do not offer the standard of security as presented in mechanical systems.

A further disadvantage in the hotel situation is that if a "master" key becomes lost, or an unauthorised copy is made, it may then be necessary to change all the locks within the hotel, which can be very costly.

There is a certain requirement for locks having wards of a particularly distinctive design, so that key blanks receivable within the locks may be restricted. Thus, for example, a particular shop may then be able to sell locks which utilise a particularly distinctive blank, and customers will only be able to have keys cut at that single shop. At the present time this would involve manufacturing totally separately locks for sale by a single shop, which is not commercially viable.

Many locks presently available which have keys of very complex pattern, which are usually cylinder locks having pins movable by the key, are such that the lock can only be actuated from one side. This is clearly disadvantageous.

Locks have to be fitted on doors which are either left-hand hung or right-hand hung. If the lock is provided with a chamfered bolt to provide a slamming action, it is customary for the chamfer to be only on one side of the bolt. The lock, as it is manufactured, has to be assembled with the bolt in position, and whilst the bolt will be correctly orientated for a door hung in one sense, it will not be correctly orientated for a door hung in the other sense. Therefore, on approximately 50% of the occasions on which a door lock is mounted on a door is necessary to at least partly disassemble the door lock in order to reverse the orientation of the bolt.

BRIEF SUMMARY OF THE INVENTION

According to one aspect of this invention there is provided a lock, said lock comprising a drive member, means for moving said drive member, a plurality of elongate members movable in response to movement of the drive member, means for selectively positioning the ends of said elongate members relative to one another, and latch means comprising a plurality of latch elements, each associated with one of the elongate members, each defining at least one passage therethrough, and each being movable to a selected position in response to a key being inserted into the lock, the arrangement being such that when the correct key is inserted in the lock the latch elements are moved to such a position that the passage in each latch element is aligned with the free end of a respective elongate member so that the drive member can be moved, causing the elongate members to pass through the passages in the latch elements.

Preferably means for selectively positioning the ends of the elongate members comprise a plurality of separate positioning members, each associated with a respective elongate member, each positioning member having an aperture therein or a recess extending therethrough forming a passage through which the respective elongate member passes, the positioning members being movable to a predetermined position in response to the insertion of a positioning element in the lock.

Conveniently the positioning element comprises a member having a predetermined profiled surface, means being provided to receive the positioning member such that the profiled surface is in contact with the positioning members, the positioning members being mounted for relative movement and being biassed into contact with the positioning element.

Advantageously each positioning member is resiliently biassed against the positioning element by a respective spring means.

Preferably each latch element comprises an element defining a recess extending therethrough or an aperture therethrough, constituting said passage, each latch element being resiliently biassed into position by means of a compression spring, a slot or the like being defined adjacent the latch elements dimensioned to receive a key with a contoured face such that the contoured face of the key is bought into contact with the latch elements, thus moving the latch elements against the spring bias imparted thereto to predetermined positions.

Preferably each latch element has a serrated or roughened face on the side through which the respective elongate member is introduced to the passage, the end of the elongate member defining at least one point.

Advantageously resilient clutch or connecting means are provided between the drive member and the said elongate members, the clutch or connecting means being able to be resiliently deformed if the drive member is moved but the elongate members are not free to move.

Preferably the elongate members are provided with recesses formed in their outer surfaces adjacent the free end thereof for engagement with the latch elements.

Conveniently resilient means are provided to bias the components of the lock towards the locked condition.

Preferably the elongate members are adapted to move an actuating member when the free ends of the elongate member pass through the latch means.

In one embodiment the ends of the elongate members remote from the latch means are connected to the actuating member, which forms a bolt or the like.

In another embodiment the free ends of the elongate members engage the actuating member when they have passed through the latch means.

Preferably the said positioning elements are located within a housing, the housing defining a slot through which the said positioning member may be inserted into and withdrawn from the lock.

Conveniently the slot is associated with means which can be secured in position to retain the positioning member in the slot.

The lock may be in the form of a door lock, the drive member comprising a member moved in response to operation of a door handle or door knob.

The lock may also be a rotary lock, the key being adapted to be inserted into a slot which forms part of the driving member so that rotation of the key causes the driving member to rotate.

Conveniently the drive member is a manually operable drive member, the drive member carrying a locking arm engagable with a lock bolt to retain the bolt in position.

Preferably the bolt is movable axially of a guide formed by the lock housing, the bolt having a spring biassed plunger at the operative end thereof.

Preferably the key is inserted into the lock through a slot, the said slot being associated with a ward plate, defining the configuration of at least part of the slot, the ward plate being releasably and replaceably mounted in position on the rest of the lock.

Advantageously the lock is provided with a bolt, the bolt comprising a first element having a radially directed resiliently radially outwardly biassed pin, and a further element mounted thereon having two diametrically opposed apertures, such that the radially outwardly biassed pin can be selectively engaged with either aperture, the second member defining a chamfered face, the arrangement being such that the chamfered face may be positioned to face in a selected one of two opposed directions.

According to another aspect of this invention there is provided a lock, said being provided with a bolt, said bolt comprising a first element having a radially directed resiliently radially outwardly biassed pin, and a further element mounted thereon having two diametrically opposed apertures, such that the radially outwardly biassed pin can be selectively engaged with either aperture, the second member defining a chamfered face, the arrangement being such that the chamfered face may be positioned to face in a selected one of two opposed directions.

According to a further aspect of this invention there is provided a lock, said lock defining a slot to receive a key, said slot being associated with a ward plate defining the configuration of at least part of the slot, the ward plate being releasably and replaceably mounted in position on the rest of the lock.

According to another aspect of this invention there is provided a lock, said locking comprising a driven member and an actuating member, therebeing a mechanical linkage between the driven member and the actuating member incorporating a latch means, therebeing a resilient clutch or connection in said mechanical linkage between the driven member and the latch means such that if the driven member is driven when the latch means is not in a condition to permit actuation of the actuating member, the resilient clutch or connection means will resiliently deform and will absorb the force applied to the driven member.

According to another aspect of this invention there is provided a key for a lock, said key having an operative blade part of predetermined substantially uniform cross section, said blade being symmetrical, in a mirror image fashion, about a plane containing the axis of the blade, the blade having profiled edges on opposite sides of the said plane, the profiled edges having point symmetry about a central point of the operative part of the blade.

Such a key may be inserted into a key slot having a cross section corresponding to that of the blade, but regardless of which end of the slot the key is inserted into, the correct profiled edge will be uppermost.

According to another aspect of this invention there is provided a lock, said lock comprising a drive member, means for moving said drive member, at least one elongate member movable in response to movement of the drive member, means for selectively positioning the end of the or each elongate member, and latch means comprising a respective latch element, associated with the or each of the elongate members, the or each latch element defining at least one passage therethrough, and being movable to a selected position in response to a key being inserted into the lock, the arrangement being such that when the correct key is inserted in the lock the or each latch element is moved to such a position that the passage in the or each latch element is aligned with the free end of a respective elongate member so that the drive member can be moved, causing the or each elongate member to pass through the passage in the respective latch element.

According to another aspect of this invention there is provided a lock, said lock comprising a drive member, means for moving said drive member, a plurality of elongate members movable in response to movement of the drive member, means for selectively positioning the ends of said elongate members relative to one another, comprising a plurality of separate positioning members, each associated with a respective elongate member, each positioning member having an aperture therein through which the respective elongate member passes, the positioning members being movable to a predetermined position in response to the insertion of a positioning element in the lock, and latch means comprising a plurality of latch elements, each associated with one of the elongate members, each defining at least one passage therethrough, and each being movable to a selected position in response to a key being inserted into the lock, the arrangement being such that when the correct key is inserted in the lock the latch elements are moved to such a position that the passage in each latch element is aligned with the free end of a respective elongate member so that the drive member can be moved, causing the elongate members to pass through the passages in the latch elements, each latch element having a serrated or roughened face on the side through which the respective elongate member is introduced to the passage, the end of each elongate member defining at least one point.

BRIEF DESCRIPTION OF THE DRAWINGS

In order that the invention may be more readily understood, and so that further features thereof may be appreciated, the invention will now be described, by way of example, with reference to the accompanying drawings in which.

DETAILED DESCRIPTION OF THE PREFERRED EMBODIMENTS

Figure 1:
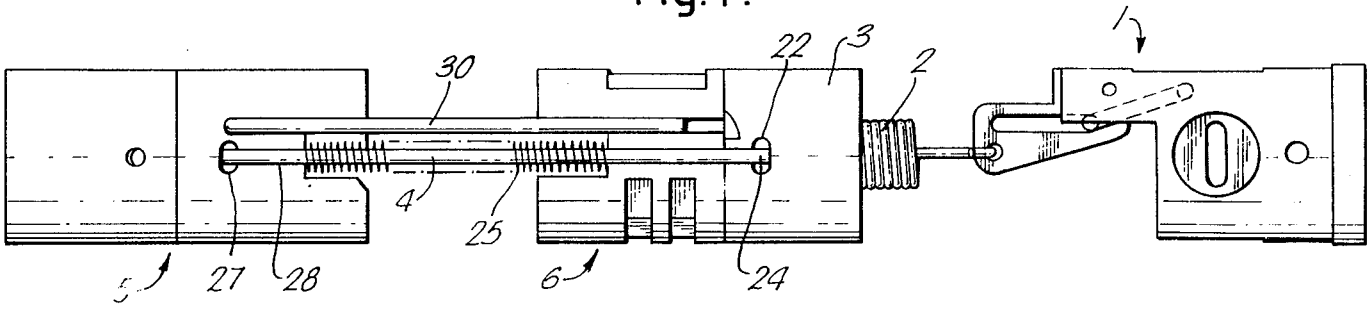
FIG. 1 is a diagrammatic side elevational view of the operative parts of a lock of the type adapted to be driven by means of a door handle or door knob, but to be associated with a key so that the lock can only be operated when an appropriate key is inserted in the lock.

Referring initially to FIG. 1 of the drawings a lock, in accordance with the invention, in the form of a door lock comprises three main parts. The first part 1, the drive part, is adapted to be associated with a door knob or handle, and is adapted to convert the rotary movement of the door knob or handle, into an axial movement. The drive part 1 is connected by means of a resilient clutch in the form of a spring 2 to a follower unit 3. The follower unit 3 is a generally cylindrical member. The follower unit 3 is connected, by means of two connecting rods 4, to a bolt unit 5. The connecting rods 4 pass on either side of a latch unit 6. The latch unit 6 is adapted so that when the lock is installed and fully operational, the latch unit may receive a key and when an appropriate key is inserted in the latch unit, an axial force which is effectively transmitted to the bolt 5, via the clutch 2 is permitted to move the bolt 5.

It is to be understood that the lock will be mounted in position on a door so that the bolt 5 will be adapted to project beyond the edge of the door to engage a striker plate mounted on an adjacent door frame.

The various components illustrated in FIG. 1 will now be described in greater detail.

Figure 2:
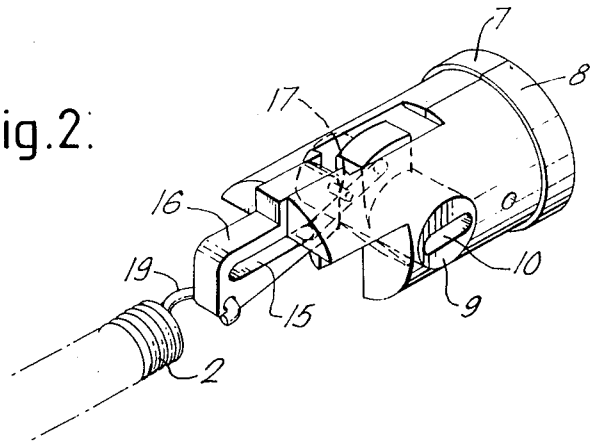
FIG. 2 is a perspective view, partly in phantom, showing the part of the lock that cooperates with the door handle.

FIG. 2 of the drawing illustrates the drive unit 1. The drive unit 1 comprises a housing formed of two housing parts 7,8, the housing receiving a rotatable spindle 9. The spindle 9 has a slot 10 extending axially therethrough, and the slot 10 is adapted to receive a drive rod which is dimensioned to be engaged by a door knob or door handle, so that the door knob or door handle may be rotated to rotate the spindle 9. As can be seen more clearly from FIGS. 3 and 4, the spindle 9 is formed integrally with two radially projecting lugs 11,12. The lug 11 is provided with an aperture 13 therein in which is inserted one arm of a substantially "U" shaped link 14. The other arm of the link 14 is received in an elongate slot 15 formed in a member 16 which is mounted for pivotal rotation about a pivot axis 17. The elongate slot 15 extends parallel to but spaced from a notional line extending through the pivot axis 17. The member 16, at a point adjacent one end of the slot 15 which is remote from the pivot axis 17 defines an aperture 18 to which is connected one end 19 of the spring 2. The lug 12 engages a stop when the lock is in the initial condition.

The pivot axis 17 is formed by a pin which passes into appropriately formed apertures formed in the housing halves 7 and 8.

Figure 6:
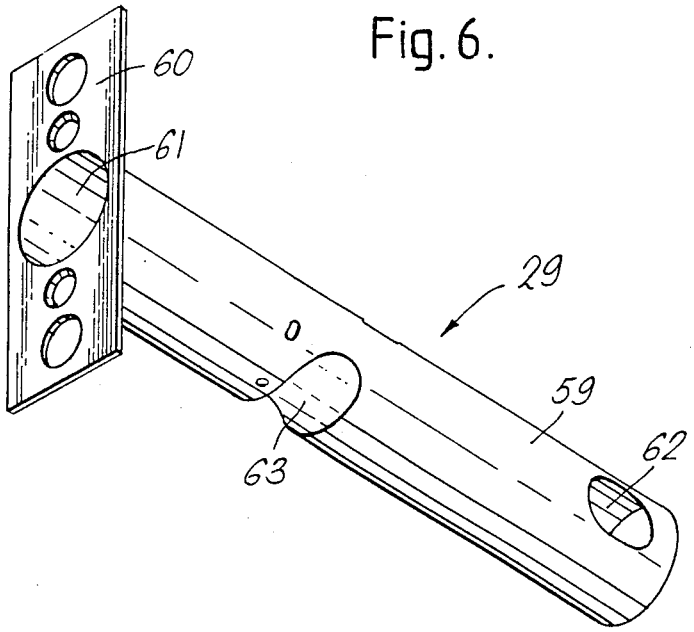
FIG. 6 is a view of a housing for the lock mechanism.

The housing halves 7 and 8 may be assembled together and then inserted, together with the remaining components of the lock as illustrated in FIG. 1, into a tubular housing, such as the housing 29 shown in FIG. 6.

Figure 3:
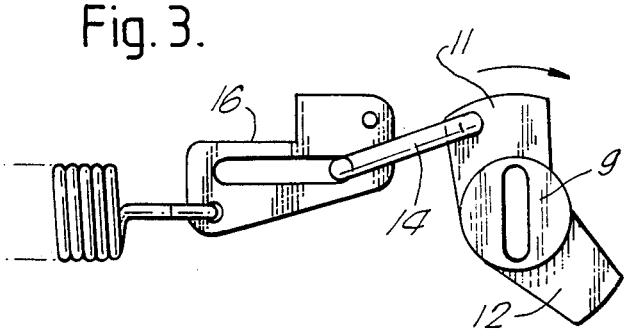
FIGS. 3 and 4 are diagrammatic views illustrating the operation of the part of the lock that cooperates with the door handle.
Figure 4:
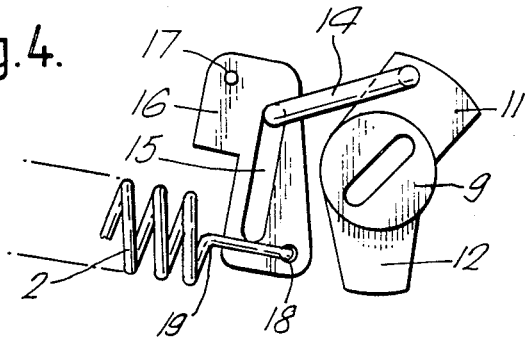

It is to be appreciated that in an initial condition of the lock, the lug 11 and the associated member 16 will have the positions illustrated in FIG. 3. If the spindle 9 is then rotated in the counter clockwise direction, the link 14 will exert a rotational force on the member 16, causing the member 16 to move to the condition illustrated in FIG. 4. It will thus be appreciated that a force will be applied to one end of the spring 2 tending to move the spring to the left as shown in FIGS. 3 or 4 or tending to move the spring to the right as shown in FIG. 1.

It is to be understood that in the embodiment illustrated the spindle 9 is intended only to be rotated in the counter clockwise direction as shown in FIG. 3.

Rotation in the clockwise direction is presented by the stop 12. However, in alternative embodiments of the invention the arrangement may be such that the spindle may be rotated in either direction from the initial condition in order to apply a tension to the spring 2.

Figure 5:
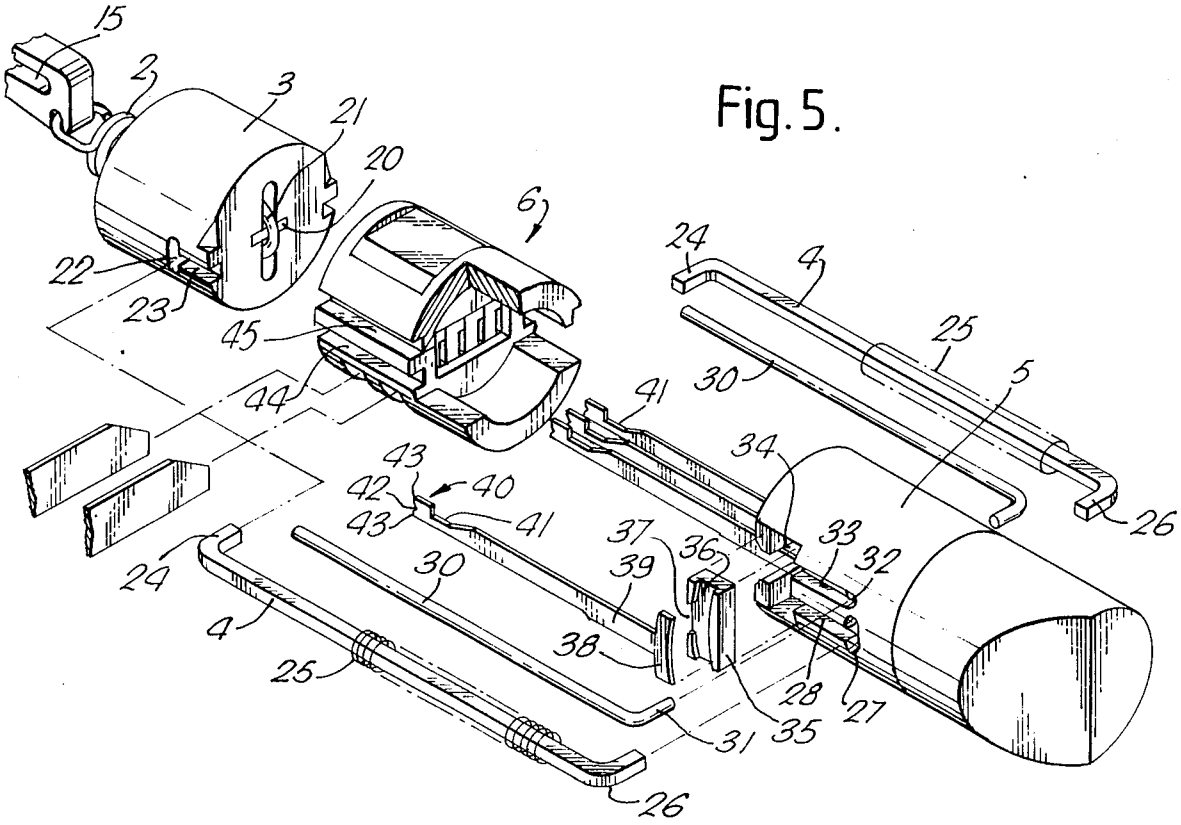
FIG. 5 is an exploded view illustrating the latch and the associated bolt.

Referring now to FIG. 5 of the drawings it can be seen that the follower unit 3 is a generally cylindrical member, which is of hollow form. However, the cylinder member forms an abutment 20 which is engaged by the other end 21 of the spring 2. At diametrically opposed member 3 recesses 22 are formed which are associated with channel portions 23 formed in the side walls. The arrangement is such that one end of a connecting rod 4, which is a cranked end 24, may be inserted in the recess 22, with part of the connecting rod lying in the recess 23. A spring 25 is mounted on each connecting rod.

The other end 26, of each connecting rod is received within a recess 27 formed in the side of the generally cylindrical bolt assembly 5, this recess 27 being connected by means of a channel portion 28 to an end face of the bolt assembly, so that the terminal portion of the connecting rod 4 may lie within the channel portion 28. It will thus be appreciated that the entire connecting rod 4 is contained within the area defined by the outer circumference of the cylindrical follower unit 3 and the bolt unit 5, so that these components may be inserted into the tubular housing 29, as shown in FIG. 6, as will be described hereinafter.

Two guide rods 30 are also provided, having inwardly cranked ends 31 received within recesses 32 formed at the inner ends of channels 33 which are parallel with the channels 28 formed in the bolt assembly 5. The channels 33 are of such a depth that the guide rods 30 are received within the circumference of the generally cylindrical bolt unit 5.

The rear portion of the bolt unit 5 is provided with a "tee" sectioned channel 34 open on one side of the bolt, as can be seen in FIG. 5, the stem of the "tee" being directed towards the rear face of the bolt assembly 5, and the head of the "tee" extending vertically. Received within the chamber formed by the head of the "tee" are four shoes 35. Each shoe is of generally rectangular cuboid configuration, and an arcuate recess 36 is formed in one side face of each shoe, the arcuate recess opening into a forwardly extending slot 37. Received within the recess 36 is a correspondingly shaped arcuate foot 38 provided at one end of an elongate element 39. When the foot 38 is received within the recess 36 with part of the elongate element 39 passing through the slot 37, the foot can move, in an arcuate manner, so that the end f the elongate element 39 remote from the foot moves upwardly and downwardly.

The end region 40, of each elongate element 39, remote from the foot 38 defines, on its upper surface, a notch or recess 41, similar to the notch or recess found on a crochet hook. The very terminal end portion of each elongate element 39 is provided with a notch 42 so that the end defines two forwardly extending pointed projections 43.

The elongate elements 39 are received within latching elements present within the latching unit 6.

The latching unit 6 comprises a substantially cylindrical housing having formed, on its outer surface, on each side, two pairs of axially extending channels 44,45 adapted slidingly to receive the connecting rods 4 and the guide rods 30. The springs 25 on the connecting rods 4 engage between the opposed end faces of the latching unit 6 and the bolt assembly 5, thus serving to bias these members apart. When the bolt 5 moves relative to the latching unit 6, the connecting rods 4 and the guide rods 30 slide through the channels 44 and 45 formed on the latching unit 6. The latching unit 6, of course, remains stationary.

Since the bolt unit 5 is rigidly connected to the follower unit 3 by means of the connecting bars 4, whenever the bolt unit 5 moves the follower unit 3 moves, and vice versa.

Figure 7:
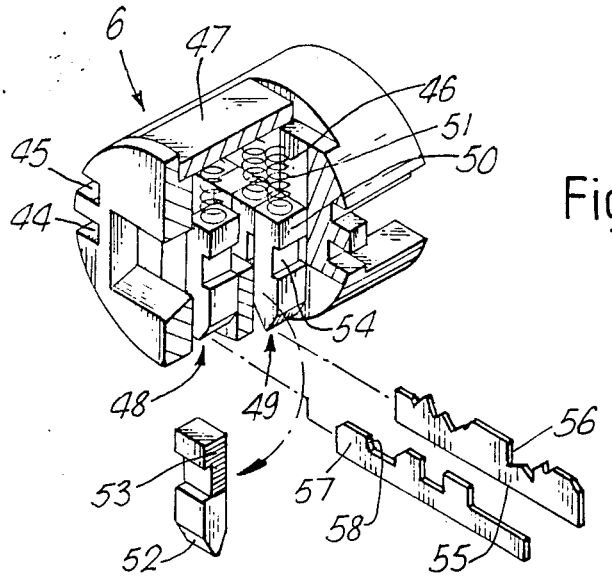
FIG. 7 is an enlarged partly cut away view of the latch unit of the lock.

FIG. 7 illustrates, in greater detail, the latching unit 6. The grooves 44,45 can be seen extending axially of the cylindrical body of the latching assembly 6.

The interior of the latching assembly 6 defines a hollow chamber 46 which is closed, at the top, by means of a cover plate 47 which is securely retained in position. The lower part of the chamber opens into two transverse slots 48,49 formed in the underside of the cylindrical latching element 6. Contained within the chamber, aligned with the two slots, are a plurality of plungers 50, each being biassed downwardly by means of an associated spring 51. There are two rows of plungers, there being four plungers in each row. Each row of plungers is aligned with one of the slots 48,49.

Each plunger 50 terminates, at its lower end with a point 52. The rear row, as illustrated, have separated or otherwise roughened front faces 53 for a purpose which will be explained hereinafter.

Each plunger has at least one notch or recess 54 formed in a side wall thereof, each notch or recess being adapted to receive, therethrough, one end of an elongate element 39 as described above. Thus each recess effectively forms a passage extending through the plunger.

When the lock is in the assembled condition, as shown in FIG. 1, the end portions of the elongate elements 39 are received within the recesses 54 of the first row of plungers, that is to say the plungers aligned with the slot 48 formed in the underside of the latching unit 6. These plungers hold the elongate elements in predetermined positions relative to one another. It is to be appreciated that the plungers are movable in a vertical up-and-down manner against the bias provided by the respective springs 51.

When the lock is in the normal condition, as has been mentioned the ends of the elongate elements 39 are received within the recesses 54 of the first row of plungers. A specially shaped piece of metal 55, having a profiled upper surface, may be slidingly inserted in position so that the profiled upper surface 56 engages the pointed ends 52 of the plungers of the first row of plungers. The plungers thus adopt different vertical positions with regard to one another. Thus the elongate elements 39 are maintained at predetermined positions which are dictated by the shape of the profiled surface 56 of the metal element or "biscuit" 55. The lock is now fully operational.

With the lock in the condition thus far described it is to be understood that the elongate elements are located in the recesses 54 in the first set of plungers 50, these plungers being maintained at predetermined positions by the biscuit 55, whereas the second set of plungers (that is to say the set of plungers aligned with the transverse slot 49) will all be maintained in their lower-most position by means of the bias provided by the springs 51. Thus the recesses 54 in the second set of plungers are not aligned with the recesses in he first set of plungers. Thus, if the spindle 9 is now rotated, the spring 2 will be placed under tension, and the follower unit 3 will be biassed to move towards the right as shown in FIG. 1, thus also biassing the bolt unit 5 towards the right. The elongate elements 39 will also tend to move towards the right and the elongate elements will slide through the recesses 54 formed in the first row of the plungers 50. The pointed ends of the elongate elements will then, however, be brought firmly into engagement with the serrated faces 53 of the second row of plungers. The second row of plungers will then resist any effort made to move the second row of plungers up and down. As will be clear from the following description it will be necessary for any person attempting to pick the lock to move the plungers up and down, whilst the lock is in this condition, to open the lock, and thus the present lock is very resistant to picking.

However, it will be appreciated that since the ends of the elongate elements engage the serrated faces 53 of the second row of plungers 50 the elongate elements 39 are not able to move to the right, and thus the bolt assembly 5 is not able to move to the right, as shown in FIG. 1, and since the follower unit 3 is rigidly connected to the bolt assembly by means of the connecting rods 4, the follower unit 3 cannot move to the right. Thus, with the lock in the initial condition, if the spindle 9 is turned, the only result is that the spring 2 becomes stretched and placed under tension.

It is to be appreciated that the maximum force that can be applied to the bolt 5, tending to move the bolt to the right, which is, of course, the maximum force that can be applied to the elongate elements 39, is dictated by the strength of the spring 2. Thus the spring 2 is chosen to have such a strength that the force transmitted through the spring will not be sufficient to bend the elongate elements 39.

A key 57 is provided for use with the lock, the key having a portion defining an upper contoured face 58. The key is adapted to be slidingly inserted into position adjacent the lock with the contoured surface 58 thereof brought into contact with the pointed ends 52 of the plungers exposed through the transverse slot 49, such that the plungers are positioned in accordance with the profile provided by the contoured upper face 58 of the key 57. Whilst a single sided key is illustrated in FIG. 7, if the key is to be used to actuate the lock from both sides of the door a double sided key will usually be provided as will be explained below.

It is intended, as has been mentioned, that the key may be slidingly inserted into position engaging the plungers 50. The contoured face 58 of the key is designed to be such that when the key is in position the recesses 54 formed in the second row of plungers 50 will be aligned with the recesses 54 present in the first row of plungers 50. It will be understood that if the spindle 6 is now rotated, the elongate elements 39 will tend to move towards the right, as illustrated in FIG. 1, and will be able to move to the right, since the free ends of the elongate elements will pass through the recesses 54 provided in the second row of plungers 50. Thus the bolt 5 may be totally withdrawn from the striker plate present on the door frame, thus permitting the door to be opened.

If the door handle is then released, so that the bolt 5 returns to its initial position under the effective bias provided by the springs 25, then the key 57 can be removed from the lock, and the lock has then returned to its initial condition. The bolt cannot then move towards the right, as shown in FIG. 1, so it is important that the key should only be removed from the lock when the door is in a closed position.

It is to be understood that, however, if the key is inserted in the lock, and the spindle 9 is then turned to withdraw the bolt, so that the free ends of the elongate elements 39 have passed through the recesses 54 present in the second set of plungers 50, and if the key is then withdrawn from the lock, before the spindle is released, the plungers of the second set of plungers 50 will be biassed downwardly by the biassing springs 51, and if the door handle is then released, so that the bolt can begin to move towards its initial position under the bias provided by the springs 25, the plungers of the second set of plungers 50 will move downwardly into the recesses 41 provided in the elongate elements 39, and the end portions 40 of the elongate elements 39 will engage the rear faces of the plungers 50 of the second set of plungers. Thus the bolt unit 5 will only move a certain distance towards its initial position, which will be sufficient to retain the door in a closed position, but will not move all the way towards the initial position of the bolt unit 5. However, it is to be appreciated, that the door may subsequently be readily opened without reinserting the key since the elongate elements are already retained within the recesses 54 provided in the second set of plungers 50 and thus if the spindle is now turned, movement of the bolt 5 towards the right as shown in FIG. 1 is permitted.

If the key 57 is reinserted in the lock at any time, the plungers 50 of the second row of plungers will again adopt positions in which they are located with the recesses 54 therein aligned with the recesses of the first row of plungers. Unless a force is applied to the door handle, the springs 24 will then move the bolt assembly 5 forwardly, thus returning the lock to a condition such that the key 41 can then be removed, leaving the lock in its initial condition as described above.

It is to be understood, at this stage, that it will be possible to manufacture a large number of identical lock mechanisms as described, and then to associate each lock and mechanism with a specific biscuit 55 and a specific key 57. The arrangement will be such that with the biscuit 55 in position the lock may be opened with the key 57. The manufacture of the lock and the manufacture of the keys and biscuits can, of course, be totally separated. This is, of course, very different from the manufacture of mechanical locks as presently provided, since inevitably each lock is specifically designed and configured to co-operate with only one particular key.

The described lock components are adapted, in the configuration as illustrated in FIG. 1, to be slidingly received within a tubular portion 59 of the housing 29 which is provided with a face plate 60 and is adapted to be mounted on a door. The arrangement is such that the bolt assembly 5 protrudes from an aperture 61 formed in the face plate 60 which communicates with the interior of the tube 59. The tube 59 is provided with apertures in the side wall, such as the aperture 62 which accommodates the spindle and an aperture 63 which is adapted to the co-aligned with the latching assembly 6. It is to be appreciated that the latching assembly 6 will remain stationary, and may be retained in position by a grub screw.

Figure 8:
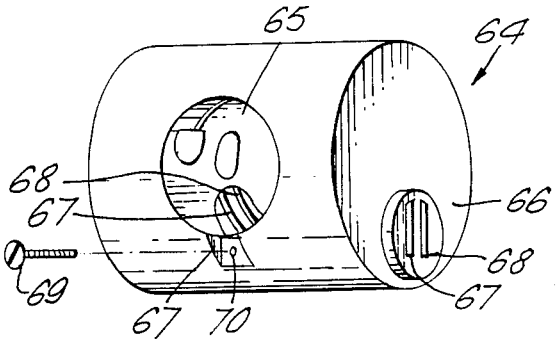
FIG. 8 is a perspective view of a housing adapted to receive the latch unit of the lock.

FIG. 8 illustrates a housing 64 which co-operates with the housing shown in FIG. 6. The housing 64 is a generally cylindrical member 64 having a diametrically extending bore 65 of such a size that the tube 59 as shown in FIG. 6 may be slid into and through the bore 65.

At least one end face 66 of the housing 64 is provided with two slots 67,68. The slot 67 is dimensioned to receive the biscuit 55 and the slot 68 is dimensioned to receive the key 57.

The housing 64 is located on the tube 59 in such a position that the housing is substantially aligned with the latching element 6. A biscuit may then be slidingly inserted through the slot 67, and as can be seen from FIG. 8 this slot 67 extends a significant way across the housing 64, so that the profiled upper surface engages the pointed ends 52 of the first set of plungers 50. The biscuit 67 may be retained in position by means of a grub screw 69 inserted through a bore 70 formed in the housing which intersects the slot 67 which receives the biscuit 55. The bore 70 is parallel with the bore 65. It will be appreciated that this screw 69 may be such as to be accessible only from the free edge of the door, so that the "biscuit" may be changed relatively readily. However, the "biscuit" may only be changed when the door is opened or, in other words, may only be changed by authorised personnel. The slot 68 is dimensioned to receive the key 57 so that the upper profiled surface thereof contacts the pointed ends 52 of the second set of plungers 50.

Whilst the described embodiment provides a certain degree of security in connection with the changing of the biscuit, it is to be appreciated that this may be achieved in other ways. However, it is desired that the biscuit may only be changed by authorised personnel but may, nevertheless, be changed relatively swiftly and easily.

The housing 64 may be double-ended, and thus the end face opposite the described face may have the same configuration as the described face. This enables the biscuit to be replaced from either side of the lock. Alternatively, the end face opposite the illustrated end face may only have one slot corresponding to the slot 68 to receive a key. This will enable the lock to be operated, by the key, from both sides of a door on which the lock is mounted.

It is also to be understood, at this stage, that in utilising the lock in accordance with the invention, if it is suspected that a key has become mislaid, or has fallen into unauthorised hands, it is possible to obtain a new biscuit 55, and a new key. The original biscuit may be withdrawn from the lock and discarded, and a new biscuit may be inserted in position. The lock will then only operate with the new key, and any person attempting to use the old key in the lock will not be able to operate the lock.

If a person attempts to open the lock using an incorrect key the plungers 50 in the second row of plungers will not be correctly aligned with the ends of the elongate elements 37. Thus, if an incorrect key is inserted in the lock, and then the handle is operated to turn the spindle 9, the lock will not open.

Figure 9:
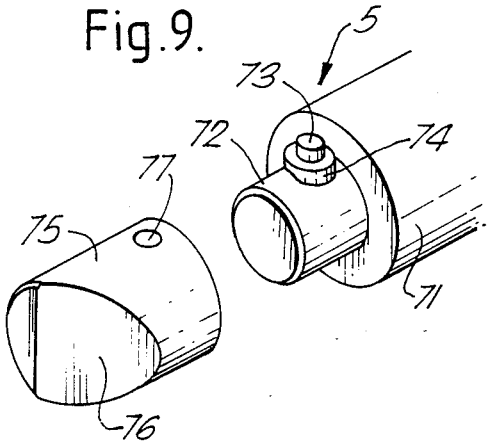
FIG. 9 is an exploded view of the end of the bolt.

Turning now to FIG. 9 of the drawings, part of the bolt assembly 5 of the lock is illustrated. The bolt assembly 5 consists of a first cylindrical member 71 which defines the recess 27 and channel 28, as described above. The member 71 is generally cylindrical, and terminates with an axially protruding boss 72 of reduced diameter which has a radially projecting outwardly spring biassed pin 73, which is retained within a small projection 74. The pin 73 may be pressed manually radially inwardly against the spring bias, until the end surface of the pin 73 becomes flush with the upper surface of the projection 74. Received on the boss 72 is a bolt member 75 which has a chamfered end portion 76. The bolt member 75 defines an axial cylindrical recess formed in the end of the member 75 remote from the chamfered end 76 and the member 75 may be slidingly and rotatably mounted upon the boss 72. Thus, the boss 72 may be inserted into the said axial cylindrical recess. The member 75 defines two diammetrically opposed apertures 77 each dimensioned to receive the spring biassed pin 73. Within the member 75 there is an annular groove, formed in the wall of the cylindrical recess, interconnecting the interior openings of the opposed apertures 77. It can be seen that if the member 75 is located on the boss 72 in the relative position illustrated in FIG. 9, the spring biassed pin 73 will engage the aperture 77, and the member 75 will be retained in position with the chamfered face 76 effectively facing towards the reader. However, if the pin 73 is depressed, for example by inserting an appropriate sized rod into the aperture 77 and pressing the pin downwardly, the pin 73 becomes disengaged from the aperture 77, and the member 75 may then be rotated through 180°, when the other aperture formed therein will be engaged by the pin 73. As the member 75 is rotated the free end of the spring biassed pin 73 will be retained within the said annular groove formed on the interior of the cylindrical recess, thus preventing the member 75 from being disengaged from the member 71. At the end of the rotation process described above, the chamfer 76 will then be facing away from the reader. It is to be understood that this particular feature may be utilised in order to change the lock rapidly from a lock adapted for use on a left-hand hung door to a lock adapted for use on a right-hand hung door.

Figure 10:
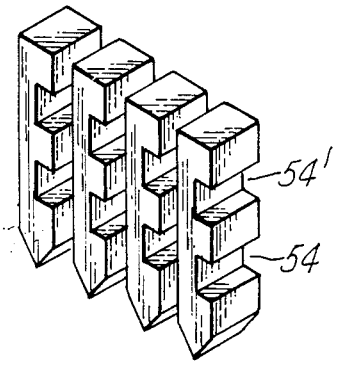
FIG. 10 is an enlarged view of part of an alternative latching unit.

Referring now to FIG. 10, a modified embodiment of the invention is illustrated in which the plungers of the second row of plungers are each provided with two recesses 54,54'. It will be understood that with a lock of this type, the lock may be opened with two different keys, one key being adapted to align the recesses 54 with the ends of the elongate elements, and the other being adapted to align the recesses 54' with the ends of the elongate elements. It is envisaged that if a large number of locks are provided a single master key may be utilised to co-align the recesses 54' of all the locks with the ends of the elongate elements. The recesses 54' are located at different positions on the respective plungers 50.

It is envisaged that with locks of the particular described configuration, as exemplified by FIG. 10, it will be possible to provide "suites" of biscuits and associated keys, which will each operate with a single master key. It may be necessary for the recesses 54' to be slightly larger than the recesses 54 to enable this to be done. However, should a master key become lost it will then merely be necessary to obtain a new "suite" of biscuits and keys, and to replace all the biscuits on all the locks and then to utilise the new master key. As has been described above, it is a relatively straightforward task to change a biscuit on any specific look.

The biscuits and keys, whilst being described as being made of metal, may instead be made of plastic and may then be readily colour-coded to assist in identification.

Whilst all four plungers have been illustrated in FIG. 10 as having two recesses it may be possible to devise embodiments having the desired properties where only one plunger has two recesses. Also embodiments may be devised, for example for use in an office, where one key will open several locks, for example locks on both the front door and an inner door, whereas another key will only open one lock, such as the lock on the front door. Thus the first mentioned key would be held by a person in a position of authority, and the second mentioned key would be held by an ordinary employee. In such a case the lock on the front door would have one or more plungers in the second row of plungers with two recesses, whereas the lock on the inner door would only have plungers with one recess, in the second row of plungers.

Figure 11:
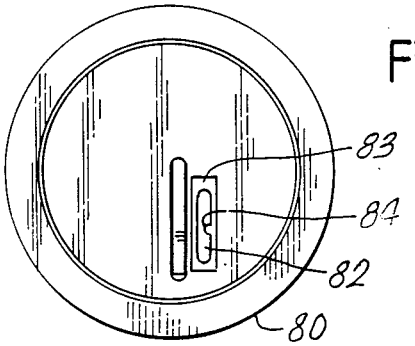
FIG. 11 is a view of an alternative form of housing.

FIG. 11 illustrates the end face of a modified housing of the type shown in FIG. 8. The housing defines a slot 80 to receive a key and also defines a separate slot 81 to receive a biscuit. The slot 81 has an end defined by an aperture 82 formed in a ward plate 83 and is releasably secured to the housing, for example by means of a retaining screw. The slot 82 defined by the ward 83 has a specific configuration. In the illustrated embodiment the slot is of generally oval form, having a single projection 84 extending into the slot from one side thereof. It will be appreciated that only keys having a configuration corresponding to that of the aperture formed by the ward plate may be inserted into the lock.

It will be appreciated, therefore, that it will be possible to mass-produce locks, and then to introduce to selected locks ward plates 83 having apertures 82 of totally different configurations. Thus the locks having ward plates of different configurations will only be adapted to receive keys of different configurations.

Thus, for example, one particular hotel may be provided with locks having a specific shape of ward plate 83, and it may then be impossible to buy key blanks adapted to fit that ward plate through normal commercial sources. This will greatly reduce the risk of any unauthorised copy keys being manufactured.

Figure 12:
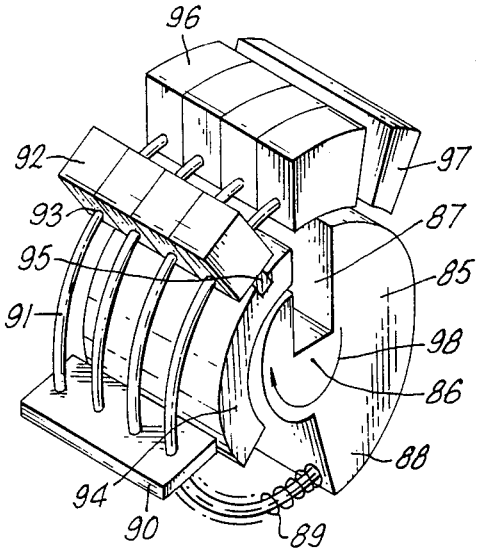
FIG. 12 is a diagrammatic view of a rotary lock in accordance with the invention.

FIG. 12 illustrates a modified version of the lock intended for use as a rotary lock. Thus this embodiment of the lock may be utilised, for example, as a car door lock or as an ignition lock, although it is to be appreciated that a lock of this type may find many different uses.

The lock illustrated in FIG. 12 comprises a rotary member 85 adapted to rotate about a longitudinal axis 86. The rotary member 85 defines a slot 87, which is a radially extending slot, adapted to receive a key having a contoured edge.

Part 88 of the rotary member projects radially outwardly and is connected to a spring clutch 89 which serves the function of providing a resilient driving connection between the projecting part 88 and a plate 90 to which is movably connected a plurality of elongate arcuate rods 91. The elongate arcuate rods 91 pass through guide members in the form of separate plungers 92 each defining an aperture 93 receiving the appropriate elongate member 91. Thus instead of passing through recesses in the sides of the plungers the elongate members pass through apertures. Of course, the rods could pass through recesses as in the earlier described embodiments.

The plungers 92 are spring biassed radially inwardly by springs (not shown). A guide member 94 is mounted in position adjacent part of the periphery of the rotary member 85, the guide member 94 defining a slot 95 adapted to receive a "biscuit" of the type described above. It will be appreciated that when a "biscuit" has been received in the slot the apertures 93 will adopt different relative positions, thus positioning the free ends of the elongate members 91. Located adjacent the free ends of the elongate members 91, and above the slot 87, are a plurality of arcuate plungers 96, each spring biassed radially inwardly by spring means (not shown). Located adjacent the plungers 96 on the side thereof remote from the plungers 92 is an actuating member 97.

It is to be appreciated that when a biscuit has been inserted in the slot 95, an appropriate key must be inserted into the slot 87 with an appropriately contoured face, in contact with the plungers 96 which are moved against the spring bias to ensure that the apertures formed in the plungers 96 are aligned with the free ends of the elongate members 91. If the key is then turned in the direction of the arrow 98 the resilient clutch 89 will be compressed, but since the free ends of the members 91 are aligned with the apertures in the plungers 96 the plate 90 will be able to move in the direction of the arrow 98. The free ends of the elongate members 91 will pass through the plungers 96 and will engage the actuating member 97, causing the actuating member 97 to move in the sense of the arrow 98. It will be appreciated that appropriate guide means will be provided to ensure that the components will move in the manner described.

The member 97 is connected to the item to be actuated by the lock, which may be a bolt which is moved to permit a door to be opened, or may be an ignition switch or the like.

It is to be appreciated that if the wrong key is inserted into the slot 87, when the key is turned in the direction of the arrow 98, the free ends of the elongate members 91 will not pass through the apertures in the plungers 96 and thus the clutch 89 will become compressed. The total force exerted on the elongate members 91 is dictated by the strength of the clutch 89. It is thus not possible to "force" the lock.

Figure 13:
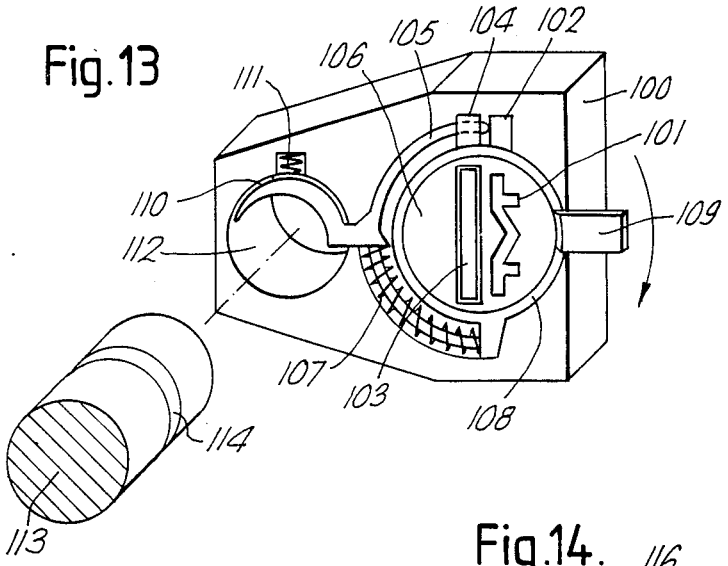
FIG. 13 is a diagrammatic perspective view illustrating a further lock in accordance with the invention.

Referring now to FIG. 13 of the drawings a further lock in accordance with the invention is shown, which is in the form of a lock suitable for use in locking, for example, sliding double glazing or a patio door. The lock illustrated in FIG. 12 comprises a housing 100 which is provided with a slot 101 adapted to receive a key to actuate the lock, the slot being aligned with a plurality of apertured plungers 102 of the type described above with reference to the previously described embodiment of the invention. The lock housing also defines a slot 103 adapted to receive a biscuit as described above with reference to the previous embodiments of the invention. The slot 103 is provided with means to seal the slot to prevent the unauthorised removal or replacement of the biscuit. Associated with the slot 103 is a further row of apertured plungers 104, the plungers 104 receiving the free ends of a plurality of elongate members 105. The members 105 are of an arcuate form and partly surround a cylindrical boss 106 which is fixed in position relative to the housing 100, and in which the slots 101, 103 are formed. The elongate members are associated with a clutch mechanism 107, which is also of arcuate form, the clutch mechanism extending between the elongate members 105 and a movable ring shaped element 108 which is mounted for rotation on the housing about the axis defined by the cylindrical boss 106. The member 108 is provided with a protruding lever 109 which can be grasped manually.

From the description given above it will be appreciated that when a biscuit has been inserted in the slot 103, and when an appropriate key has been inserted in the slot 101 the apertures in the apertured plungers 102 will be aligned with the free ends of the elongate members 105 as guided by the plungers 104, and thus the protruding lever 109 may be depressed, thus rotating the ring shaped element 108.

It is to be observed that the ring shaped element 108 carries with it a locking arm 110 which is associated with a biassing spring 111. The locking arm 110 extends, in the locking condition illustrated in FIG. 12, into a cylindrical passage 112 which extends through the lock housing 100. A cylindrical bolt 113 is provided which is movable axially within the cylindrical passage 112. The bolt 113 is provided with a peripheral groove 114 therein adapted to receive the locking arm 110 when the bolt is inserted in the passage 112 and the groove 114 is aligned with the arm 110.

Figure 14:
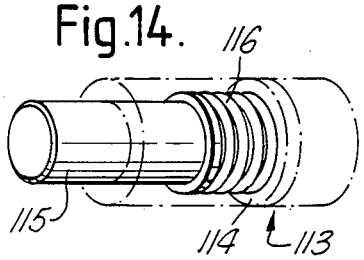
FIG. 14 is a side view, partly in phantom, showing a bolt forming part of the lock of FIG. 13.

The bolt 113 is shown in greater detail in FIG. 14, and it can be seen that the operative end 114 of the bolt is provided with a spring loaded plunger 115 which is associated with a helical spring 116 contained within a hollow cavity of the bolt. The annular groove 114 can also be seen in FIG. 14.

When the described lock is in the initial condition the locking arm 110 will be received within the circumferential groove 114 in the bolt 113, thus preventing the bolt 113 from moving axially within the cylindrical passage 112. If the key is inserted into the slot 101, and the lever 109 is then depressed, the ring shaped element 108 will be free to rotate, thus enabling the locking arm 110 to be removed from the groove 114 against the bias imparted by the spring 111. The bolt 113 may then be moved axially through the channel 112 by applying manual pressure to the exposed end of the bolt. The bolt advances into the channel 112, and the operative end 114 of the bolt is brought into engagement with an appropriate locking detent. The plunger 115 will be driven into the bolt against the bias of the spring 116. When the bolt 113 has been urged, by an appropriate distance, into the channel 112 the lever 109 may be released and the locking arm 110 will then return to its initial position, thus engaging, in the described embodiment, the exposed end of the bolt 113. The key may then be removed and the bolt is thus retained in a locking condition. If the key is then re-inserted in the lock, and the lever 109 is again actuated, the locking arm 110 will be disengaged from the bolt, and the bolt will then return to its initial condition under the bias imparted thereto by the spring 116. The bolt is thus returned to the initial condition described above.

It is to be noted that this embodiment of the invention comprises a rotary lock, but in the rotary lock the key does not move relative to the plungers. Of course, in the embodiment described with reference to FIG. 12 the key does move relative to the plungers and will thus be subjected to some wear which is not totally desirable.

Figure 15:
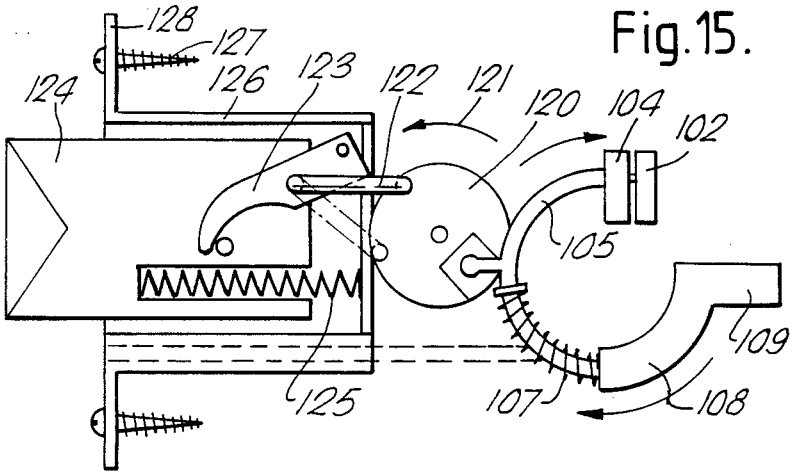
FIG. 15 is a diagrammatic view of yet another embodiment of a lock in accordance with the invention.

FIG. 15 shows an alternative form of lock, for example for use as a door lock, which incorporates components similar to the those utilised in FIG. 13. Thus the lock again presents apertured plungers 102, 104 associated with elongate members 105. The plungers 102, 104 will again be associated with slots for receiving the key and biscuit, as described above, but these slots are not illustrated. Again a clutch mechanism 107 is provided associated with a movable member 108 having a projecting lever 109. It can be seen that these components will operate in the same way as the corresponding components illustrated in FIG. 13, but on actuation of the lock a rotary member 120, which is connected to the ring 108, is caused to rotate in the direction of the arrow 121. The rotary member is connected, by means of an arm 122 to a hook mechanism 123. The hook mechanism is adapted to draw back a spring biassed bolt 124 biassed by means of a spring 125, which is mounted in a housing 126 adapted to be secured to a door or the like by means of screws 127 passing through an apertured front plate 128 forming the front of the housing 126.

It can be seen that as the rotary member 120 rotates, so the bolt 124 will be drawn back into a retracted position.

Figure 16:
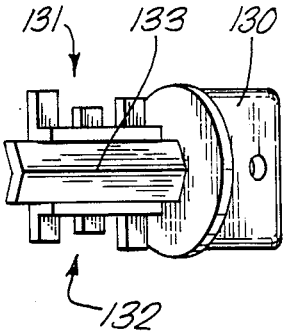
FIG. 16 is a side view of a key for use with a lock in accordance with the invention.
Figure 17:
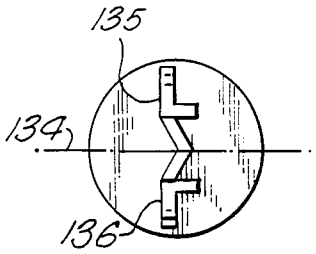
FIG. 17 is an end view of the key shown in FIG. 16.

FIGS. 16 and 17 illustrate a key 130 which may be utilised with embodiments of the invention as illustrated in FIGS. 1 to 9. It is to be understood, at this stage, that the embodiments illustrated in FIGS. 1 to 9 may be in the form of locks which may be actuated from both sides of a door, utilising the same key. Whilst it would, of course, be possible to utilise a selection of plungers such that the same key could be inserted from both sides of the door, this is not desirable since it significantly reduces the number of combinations available. It is thus preferred to utilise a biscuit which produces a very individual pattern of apertures in the plungers associated with the biscuit, when the biscuit has been inserted in position in the lock. It is thus necessary to provide a key having two operative sides, each operative side being adapted to locate the plungers associated with the key slot in an appropriate position when the key has been inserted into the door from an appropriate side. Thus, considering the key illustrated in FIG. 16 it is to be noted that, for example, the side 131 of the operative blade of the key, shown at the top is to be intended to be utilised when the key is inserted from the left hand side of the door, whereas the side 132 of the operative blade of the key is to be utilised when the key is inserted from the right hand side of the door. It will thus be understood that the opposed profiled edges of the operative blade of the key have symmetry about a central point 133. This is in contrast with most double sided keys which are symmetrical, as far as the profiled edges are concerned, about the longitudinal axis of the key.

In order to ensure that when the key is inserted into the lock the appropriate profiled face is in contact with the plungers, the blade of the key is provided with a specific profile as shown in FIG. 17. As can be seen, the profile has a plane of symmetry 134 and the upper parts of the profile 135, above the plane 134 is effectively a mirror image, at the plane 134 of the lower part 136 which is located on the opposite side of the plane 134. It is thus to be understood that the lock will be provided with appropriate ward plates on either side of the lock, or other appropriately shaped apertures forming the ends of the slots into which the key is to be inserted and the arrangement is such that when the key is in the correct orientation to be inserted into the lock the appropriate profiled face of the key will be in a position to be brought into contact with the plungers associated with the key slot.

Whilst the invention has been described with reference to locks provided with resilient spring or clutch means it is to be understood that embodiments of the lock could be fabricated without such a clutch, but such a embodiments are not to be preferred, since without the presence of the clutch it might conceivably be possible, if the wrong key is utilised, to buckle the elongate elements or rods 39 or 91, thus making the lock inoperable. If the embodiment illustrated in FIG. 12 is modified so as not to have the clutch, it would be possible for the item to be actuated by the lock to be actuated in response to rotation of the rotatable member 85, and thus the actuating member 97 could be omitted.

Figure 18:
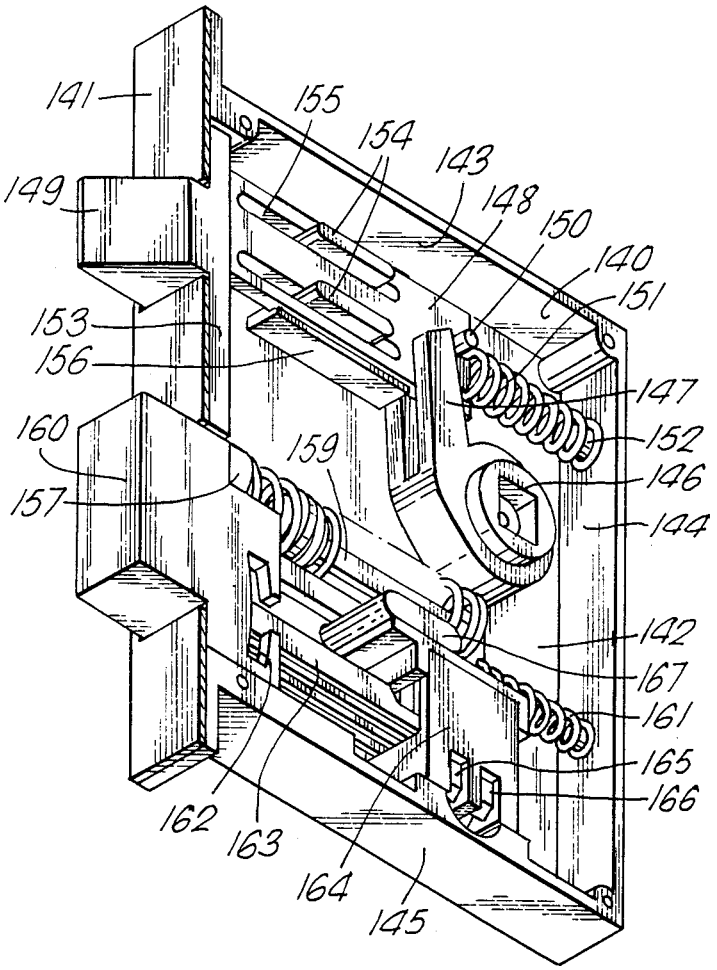
FIG. 18 is a perspective view of a mortice lock in accordance with the invention.

FIG. 18 illustrates a mortice lock embodying the invention.

The mortice lock is contained within a housing 140 of conventional design, having a face plate 141 adapted to be located on the edge of the door, the main body of the housing being received within a recess formed in the door. The main body of the housing consists of a base plate 142 and three upstanding side walls 143, 144 and 145. A cover will be provided, but this is omitted for the sake of clarity of illustration.

Pivotally mounted within the main part of the casing is a spindle 146 adapted to be rotated by a drive rod connected to a door handle or the like. The spindle 146 is provided with a radially extending arm 147, the end part of which is bifurcated and which passes above and below a drive plate 148 integrally formed with a door catch 149. The drive plate 148 has, towards its rear edge, an upwardly extending projection 150 which engages one end of a spring 151, the other end of which engages a projection 152 formed on the side wall 144. The spring biasses the drive plate to the right as shown. The head of the latch is enlarged in the vertical direction within the casing, thus forming a vertically extending drive element 153. The drive plate 148 is guided by guide elements 154 which project from the base 142 of the housing through elongate slots 155 formed in the drive plate 148. The drive plate 148 may also be supported by a projecting support element 156 adjacent its lower edge.

It will be appreciated that as the spindle 146 is rotated in the clockwise direction as shown the spring 151 will be compressed, and the latch 149 will be retracted within the casing. Simultaneously, however, the vertical drive element 153 will move rearwardly into the casing.

The lower end of the vertical drive element 153 is provided with a projection 157 which engages one end of the spring 158. The spring 158 is a helical spring which surrounds an arm 159 formed on a dead-bolt. The spring 158 engages the dead-bolt adjacent the base of the arm. The arrangement is such that as the drive plate 153 is moved within the housing, the spring 158 becomes compressed, thus applying a force tending to move the dead-bolt 160 into the housing. The dead-bolt is biassed forwardly by means of a spring 161, which is weaker than the spring 158.

Formed in an extension of the dead-bolt is an arcuate recess 162 which receives arcuate projections formed on the end of elongate elements 163 which correspond to the elongate element 39 illustrated in FIG. 5. The elongate elements 163 are received within a latching unit 164 which corresponds with the latching unit 6 illustrated in FIG. 5, although the configuration of the outer housing is slightly different.

The latching unit 164 is provided with two slots 165,166 adapted to receive, respectively, a biscuit and a key.

The bolt 160 is mounted for sliding movement on a projecting guide element 167.

It will be appreciated tat if the door handle driving the spindle 146 is turned when there is no key present in the slot 166, whilst the door latch 149 will be drawn back into the lock housing, and the spring 158 will be compressed, the dead-bolt 160 will not be drawn back into the housing, since the elongate elements 163 will not be able to pass into the latching unit 164.

However, if a correct key is inserted into the slot 166, and then the door handle is turned to rotate the spindle 146 in the clockwise direction, the door latch 149 will be drawn back into the lock, and the spring pressure applied by the spring 158 to the base of the arm 159 will compress the weaker spring 161, thus drawing the bolt 160 back into the lock. The door on which the lock is fitted may then be opened. If, whilst the dead-lock 160 is retained within the housing, the key is removed from the slot 166, the plungers corresponding to the plungers 50 aligned with the slot 166 will engage recesses formed in the upper surfaces of the elongate elements 163, and this will effectively prevent the bolt 160 from returning to the condition illustrated in FIG. 18. Instead, the bolt 160 will be retained fully within the housing. The door may then be opened and closed, utilising the door handle to rotate the spindle 146, the door being kept in the closed condition solely by means of the door catch 149. However, if the key is re-inserted into the slot 166, the elongate elements 163 will become released, and the bolt will again be driven to the extended position shown in FIG. 18 by the spring 161 if, at that moment, the door handle 146 is released.

It will thus be appreciated that the lock, as illustrated in FIG. 18, has many features of the lock illustrated in FIGS. 1 to 8 of the accompanying drawings.

Whilst embodiments using sets of four plungers have been described, the numbers of plungers may be reduced, and thus a very simple lock may have only one plunger in each row of plungers. Alternatively the number of plungers may be increased to five or more, thus increasing the security of the lock, but making the lock larger.

What is claimed is:

1. A lock, said lock comprising a drive member, means for moving said drive member, a plurality of elongate members movable in response to movement of the drive member, means for selectively positioning the ends of said elongate members relative to one another, and latch means comprising a plurality of latch elements, each associated with one of the elongate members, each defining at least one passage therethrough, and each being movable to a selected position in response to a key being inserted into the lock, the arrangement being such that when the correct key is inserted in the lock the latch elements are moved to such a position that the passage in each latch element is aligned with the free end of a respective elongate member so that the drive member can be moved, causing the elongate members to pass through the passages in the latch elements.

2. A lock according to claim 1 wherein the means for selectively positioning the ends of the elongate members comprise a plurality of separate positioning members, each associated with a respective elongate member, each positioning member having an aperture therein or a recess extending therethrough forming a passage through which the respective elongate member passes, the positioning members being movable to a predetermined position in response to the insertion of a positioning element in the lock.

3. A lock according to claim 2 wherein the positioning element comprises a member having a predetermined profiled surface, means being provided to receive the positioning member such that the profiled surface is in contact with the positioning members, the positioning members being mounted for relative movement and being biassed into contact with the positioning element.

4. A lock according to claim 3 wherein each positioning member is resiliently biassed against the positioning element by a respective spring means.

5. A lock according to claim 1 wherein each latch element comprises an element defining a recess extending therethrough or an aperture therethrough constituting said passage, each latch element being resiliently biassed into position by means of a compression spring, a slot or the like being defined adjacent the latch elements dimensioned to receive a key with a contoured face such that the contoured face of the key is bought into contact with the latch elements, thus moving the latch elements against the spring bias imparted thereto to predetermined positions.

6. A lock according to claim 1 wherein each latch element has a serrated or roughened face on the side through which the respective elongate member is introduced to the passage, the end of the elongate member defining at least one point.

7. A lock according to claim 1 wherein resilient clutch or connecting means are provided between the drive member and the said elongate members, the clutch or connecting means being able to be resiliently deformed if the drive member is moved but the elongate members are not free to move.

8. A lock according to claim 1 wherein the elongate members are provided with recesses formed in their outer surfaces adjacent the free end thereof for engagement with the latch elements.

9. A lock according to claim 1 wherein resilient means are provided to bias the components of the lock towards the locked condition.

10. A lock according to claim 1 wherein the elongate members are adapted to move an actuating member when the free ends of the elongate member pass through the latch means.

11. A lock according to claim 10 wherein the ends of the elongate members remote from the latch means are connected to the actuating member, which forms a bolt or the like.

12. A lock according to claim 10 wherein the free ends of the elongate members engage the actuating member when they have passed through the latch means.

13. A lock according to claim 2 wherein the said positioning elements are located within a housing, the housing defining a slot through which the said positioning member may be inserted into and withdrawn from the lock.

14. A lock according to claim 13 wherein the slot is associated with means which can be secured in position to retain the positioning member in the slot.

15. A lock according to claim 1 in the form of a door lock, the drive member comprising a member moved in response to operation of a door handle or door knob.

16. A lock according to claim 1 wherein the lock is a rotary lock, the key being adapted to be inserted into a slot which forms part of the driving member so that rotation of the key causes the driving member to rotate.

17. A lock according to claim 1 wherein the drive member is a manually operable drive member, the drive member carrying a locking arm, engagable with a lock bolt to retain the bolt in position.

18. A lock according to claim 17 wherein the bolt is movable axially of a guide formed by the lock housing, the bolt having a spring biassed plunger at the operative end thereof.

19. A lock according to claim 1 wherein the key is inserted into the lock through a slot, the said slot being associated with a ward plate, defining the configuration of at least part of the slot, the ward plate being releasably and replaceably mounted in position on the rest of the lock.

20. A lock according to claim 1 wherein the lock is provided with a bolt, the bolt comprising a first element having a radially directed resiliently radially outwardly biassed pin, and a further element mounted thereon having two diametrically opposed apertures, such that the radially outwardly biassed pin can be selectively engaged with either aperture, the second member defining a chamfered face, the arrangement being such that the chamfered face may be positioned to face in a selected one of two opposed directions.

21. A lock, said lock comprising a driven member an actuating member, wherein a mechanical linkage is situated between the driven member and the actuating member incorporating a latch means, a resilient clutch or connection in said mechanical linkage provided between the driven member and the latch means such that if the driven member is driven when the latch means is not in a condition to permit actuation of the actuating member, the resilient clutch means will resiliently deform and will absorb the force applied to the driven member.

22. A lock, said lock comprising a drive member, means for moving said drive member, at least one elongate member movable in response to movement of the drive member, means for selectively positioning the end of the or each elongate member, and latch means comprising a respective latch element, associated with the or each of the elongate members, the or each latch element defining at least one passage therethrough, and being movable to a selected position in response to a key being inserted into the lock, the arrangement being such that when the correct key is inserted in the lock the or each latch element is moved to such a position that the passage in the or each latch element is aligned with the free end of a respective elongate member so that the drive member can be moved, causing the or each elongate member to pass through the passage in the respective latch element.

23. A lock, said lock comprising a drive member, means for moving said drive member, a plurality of elongate members movable in response to movement of the drive member, means for selectively positioning the ends of said elongate members relative to one another comprising a plurality of separate positioning members, each associated with a respective elongate member, each positioning member having an aperture therein through which the respective elongate member passes, the positioning members being movable to a predetermined position in response to the insertion of a positioning element in the lock, and latch means comprising a plurality of latch elements, each associated with one of the elongate members, each defining at least one passage therethrough, and each being movable to a selected position in response to a key being inserted into the lock, the arrangement being such that when the correct key is inserted in the lock the latch elements are moved to such a position that the passage in each latch element is aligned with the free end of a respective elongate member so that the drive member can be moved, causing the elongate members to pass through the passages in the latch elements, each latch element having a serrated or roughened face on the side through which the respective elongate member is introduced to the passage, the end of each elongate member defining at least one point.

* * * * *

UNITED STATES PATENT AND TRADEMARK OFFICE

CERTIFICATE OF CORRECTION

PATENT NO. : 4,898,011

DATED : February 6, 1990

INVENTOR(S) : Walter J. Nugent

It is certified that error appears in the above-identified patent and that said Letters Patent is hereby corrected as shown below:

Col. 1, line 52, please delete "separately" and insert --separate--.

Col. 6, line 52, between the words "posed" and "member", please insert the following phrase: --positions on the exterior of the cylindrical--.

Col. 7, line 25, please delete the letter "f" and insert the word --of--.

Col. 7, line 68, please delete "separated" and insert --serrated--.

Col. 16, line 38, please delete the word "a".

Col. 17, line 38, please delete "tat" and insert --that--.

Signed and Sealed this

Fourth Day of June, 1991

*Attest:*

HARRY F. MANBECK, JR.

*Attesting Officer*

*Commissioner of Patents and Trademarks*